US005224884A

United States Patent [19]

Singer et al.

[11] Patent Number: 5,224,884

[45] Date of Patent: Jul. 6, 1993

[54] HIGH CURRENT, LOW VOLTAGE DROP, SEPARABLE CONNECTOR

[75] Inventors: Michael T. Singer, Kanata; Robert Noffke, Ottawa; David A. Gilmour, Burlington, all of Canada

[73] Assignee: Digital Equipment Corporation, Maynard, Mass.

[21] Appl. No.: 759,716

[22] Filed: Sep. 12, 1991

Related U.S. Application Data

[63] Continuation of Ser. No. 468,322, Jan. 22, 1990, abandoned.

[51] Int. Cl.[5] ..... H01R 4/48

[52] U.S. Cl. ..... 439/819; 439/886

[58] Field of Search ..... 439/886, 887, 842, 848, 439/851, 856, 817, 818, 819, 821, 108

[56] References Cited

U.S. PATENT DOCUMENTS

| | | | |
|---|---|---|---|
| 1,327,844 | 1/1920 | Schaeffer | 439/887 |
| 1,780,778 | 11/1930 | McFadden | 439/842 |
| 2,105,884 | 6/1936 | Hanser et al. | 439/887 |
| 2,476,886 | 7/1949 | Miller et al. | 439/886 |
| 4,357,069 | 11/1982 | Milora | 439/856 |
| 4,657,333 | 4/1987 | Anderson | 439/817 |
| 4,824,383 | 4/1989 | Lemke | 439/108 |

FOREIGN PATENT DOCUMENTS

| | | | |
|---|---|---|---|
| 0226811 | 7/1987 | European Pat. Off. | 439/821 |
| 8911169 | 11/1989 | European Pat. Off. | 439/108 |
| 8300945 | 3/1983 | PCT Int'l Appl. | 439/886 |

*Primary Examiner*—Larry I. Schwartz
*Assistant Examiner*—Hien D. Vu
*Attorney, Agent, or Firm*—Barry N. Young; Ronald C. Hudgens

[57] ABSTRACT

A low voltage drop, high current electrical connector which can be releasably mated with associated contacts is disclosed. The connector makes use of elongate contact arms cantilevered in a housing. Each contact arm is made up of at least two beams one of which has relatively high electrical conductivity but relatively poor mechanical spring characteristics. The other has relatively low electrical conductivity but relatively good mechanical spring characteristics. In this way the mechanical and electrical characteristics such as contact force and conductivity may be controlled, balanced and optimized. As one possibility there could be a single spring steel beam backing a stack of sheets of high conductivity copper. As another possibility, there could be sheets of high conductivity copper alternating in a stack with sheets of copper spring which is about half as conductive as pure copper. Instead of a cantilevered spring a coil spring located at the contact surface could be used.

11 Claims, 2 Drawing Sheets

HIGH CURRENT, LOW VOLTAGE DROP, SEPARABLE CONNECTOR

This application is a continuation of application Ser. No. 07/468,322 filed Jan. 22, 1990, now abandoned.

BACKGROUND OF THE INVENTION

This invention relates to electrical connectors which can be releasably mated with associated contacts and, in particular, to such connectors intended to carry low voltage (1-10 volts) and high current (hundreds of amps).

One type of conventional connector for connecting a power supply to bus bars is the semi-permanent type in which the connection is made by a nut and bolt, for example. Separable connectors, using for example a pin and socket connection, are also available but, to date, these have suffered from a high contact resistance giving rise to a high voltage drop and high heat generation. As a consequence, the current rating of such available separable connectors has to be limited to a value considerably below the desired value for the power supply. Additionally, separate connectors have to be used for both bus bars.

SUMMARY OF THE INVENTION

It is a principal object of the present invention to achieve a separable connector in which the contact resistance can be reduced with respect to prior separable connectors so that the voltage drop and heat generation can be minimized.

It is another object of the present invention to achieve a separable connector in which the contact resistance is reduced to the point that a single connector can be used for connection to both bus bars.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

The present invention achieves these objects using a simple and compact construction. More particularly, as an example, a 16 millivolt voltage drop at 300 amps giving a temperature rise not greater than about 6° C. is attainable.

The invention is based on the concept of separating the desired spring or force characteristics of a contact arm from the desired electrical characteristics and using two different metals to achieve these characteristics rather than trying to obtain the desired characteristics using a single metal.

To achieve the objects and in accordance with the purpose of the invention, as embodied and broadly described herein, the electrical connector of this invention comprises a housing and at least one elongate contact arm secured to the housing and having proximate a free end thereof a contact surface for engagement with the mateable contact, the elongate contact arm being formed of a material which has a relatively high electrical conductivity but relatively poor mechanical spring characteristics and spring means formed of a material which has a relatively low electrical conductivity but relatively good mechanical spring characteristics, the spring means mounted in the housing to act on the contact arm and apply contact force to the contact surface.

The spring means may be, for example, a beam of spring steel or a steel coil spring acting on the contact arm adjacent the contact surface.

According to another broad aspect, the present invention provides an electrical connector for releasable connection to a mateable contact, the connector comprising a housing of insulating material and at least one elongate contact arm secured to the housing and formed as a cantilever having proximate a free end thereof a contact surface for engagement with the mateable contact, the elongate contact arm being formed of at least two beams one of which has relatively high electrical conductivity but relatively poor mechanical spring characteristics and the other of which has relatively low electrical conductivity but relatively good mechanical spring characteristics.

According to a more specific aspect, the present invention provides an electrical connector for releasable connection to two mateable contacts, the connector comprising a housing of insulating material formed with a slot for reception of the two mateable contacts, the slot extending inwardly from an end of the housing, two elongated contact arms secured to the housing and formed as cantilevers extending substantially parallel to the slot and on opposite sides of the slot and each cantilever having proximate a free end thereof a respective contact surface, the two contact surfaces projecting laterally into the slot for respective engagement with the mateable contacts, each elongate contact arm being formed of at least two beams, one of which has relatively high electrical conductivity but relatively poor mechanical spring characteristics and the other of which has relatively low electrical conductivity but relatively good mechanical spring characteristics.

In a first preferred embodiment the or each elongate contact arm is formed with a stack of high conductivity copper sheets and a beam of spring steel backing the copper sheets. The spring steel beam may be made of one or more layers.

In a second preferred embodiment the or each elongate contact arm is formed with alternating sheets of high conductivity copper and copper spring metal having a conductivity approximately half that of the high conductivity copper.

It should be apparent that different combinations of materials could be used, providing one has relatively high conductivity and poor mechanical spring characteristics while the other has relatively low conductivity and high mechanical spring characteristics. Also, the or each elongate contact arm could be formed in different configurations, e.g., a spring steel backing sheet in addition to laminated copper/copper spring sheets.

The accompanying drawings, which are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
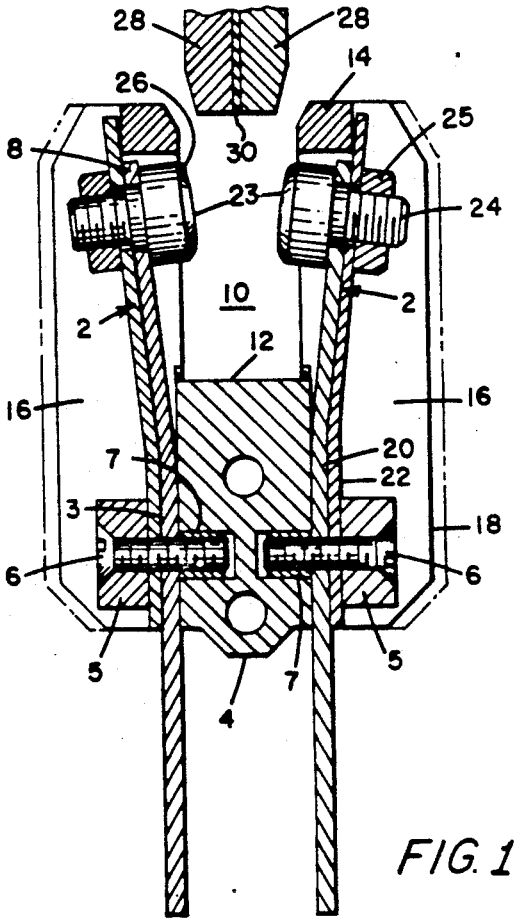
FIG. 1 is a cross-sectional view through a connector according to a first embodiment of the invention.

Referring to FIG. 1, two elongate contact arms 2 are formed as cantilevers extending upwardly from ends 3, which are secured to an insulating housing 4 by means of respective clamps 5 held by screws 6 received in tapped holes 7 of the housing 4, to free ends 8. The housing 4 is formed with a slot 10 which extends inwardly from that end of the housing opposite the end to which the contact arms 2 are secured, the slot extending parallel to and between the contact arms 2 as far as an abutment 12. Located at the mouth of the slot 10 is a pair of preload stops or abutment 14, one at either side of the slot, the preload abutments being formed integrally with end walls 16 of the housing 4. The elongate sides 18 of the housing are open through to the slot 10.

Figure 6:
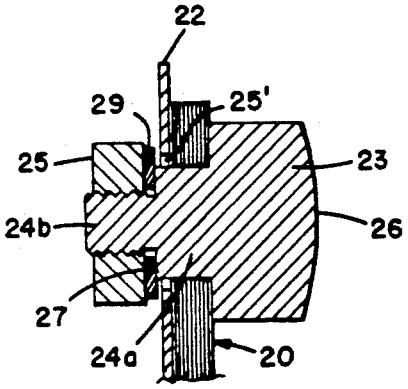
FIG. 6 is an enlarged sectional view of a portion of a contact arm showing a modification which permits relative movement of different parts of the contact arm.

Each contact arm 2 is formed of a stack of high conductivity copper sheets 20 backed by a beam 22 composed of spring steel. Proximate the free end 8 of each contact arm 2 there is provided a copper contact 23 which is secured in a hole through the contact arm and projects laterally into the slot 10. The contact may be secured to the contact arm by any suitable technique such as soldering, brazing or welding of the contact to the copper sheets 20. Alternatively, or additionally, each contact 23 may be provided with a threaded shank 24 receiving a nut 25 bearing against the beam 22 as shown. It is preferred, however, that the beam 22 be permitted to slide relative to the copper sheets 20 and this can be achieved by means of the modification illustrated in FIG. 6. The shank 24 has first unthreaded portion 24*a* and a second threaded portion 24*b* of reduced diameter. The portion 24*a* passes through the hole in the contact arm and it is noted that the hole 25 in the beam 22 is oversize with respect to shank portion 24*a*. A shoulder 27 defined between shank portions 24*a* and 24*b* stands proud of the beam 22 and a spring washer 29 is received between the nut 25 and the shoulder 27 so that, even with the nut fully tightened, the beam 22 is not clamped and is free to move within the limits defined by the oversize hole 25. The contact 23 may be coated with nickel and then with gold or a silver alloy and has a spherical contact surface 26 disposed in the slot 10.

Each contact arm 2 is arranged such that, if unrestrained at its free end 8, the contact arm would assume a vertical orientation and the contact face 26 would assume a position further laterally into the slot 10 than appears in FIG. 1. Engagement of the free end 8 of the contact arm with the abutment 14 prevents the contact face from moving to that position and holds the contact arm in a preloaded state in which a contact force is being exerted at the contact surface 26.

Figure 2:
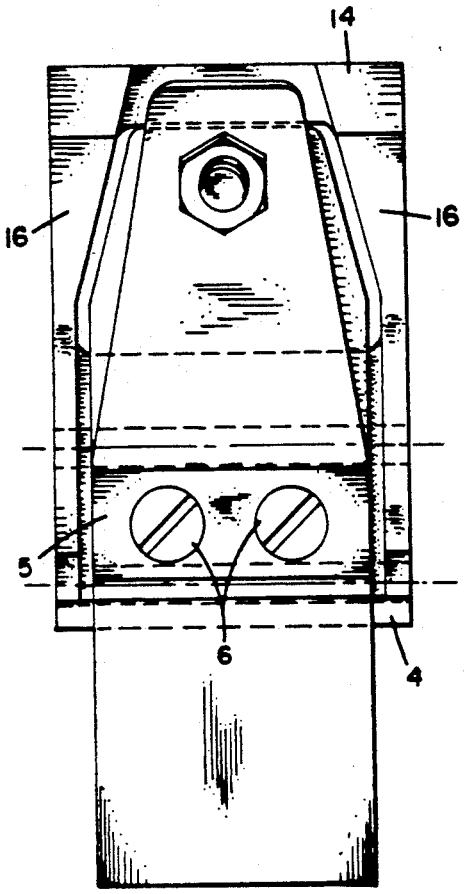
FIG. 2 is a side view of the connector of FIG. 1.

As seen in FIG. 2 the contact arms 2 are shaped as quadrilaterals in plan, extending from their full width adjacent the clamps 5 to their narrowest at the free ends.

In operation when a pair of conductors or bus bars 28 separated by an insulator 30 is introduced into the mouth of the slot 10 each conductor 28 engages a respective preloaded contact 23 at the contact surface 26 and establishes electrical connection therewith. The preloading provides the high contact force necessary to minimize the contact resistance between the contacts 23 and the mateable conductors 28.

As shown in FIG. 1 the free end of beam 22 extends beyond the free end of the copper sheets 20 so that it is actually the free end of beam 22 which engages the preload abutment 14. However, the copper sheets 20 could be made ceremonious with the beam 22 at the free end in which case the thickness of the preload abutment 14 would have to be reduced so as to engage the composite contact arm 2 and allow the contact 23 to extend the correct distance into the slot 10.

That end of the beam 22 which is secured to the housing 4 does not, in the embodiment shown, extend out of the lower end of the housing but the sheets 20 do for connection, permanently or semi-permanently, to mating conductor paths, such as, for example, the positive and negative paths of a power supply.

Figure 3:
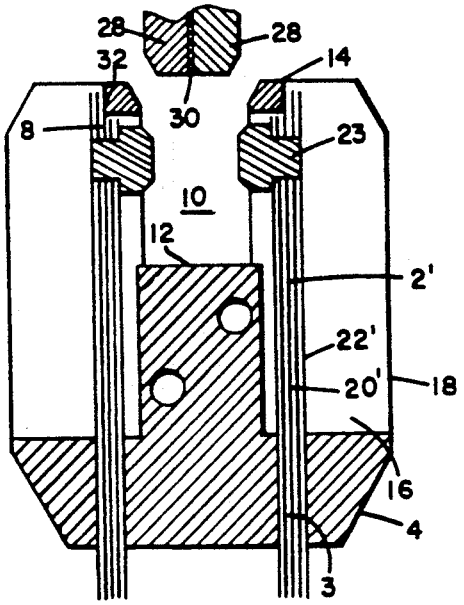
FIG. 3 is a cross-sectional view through a connector according to a second embodiment of the invention.

In the embodiment shown in FIG. 3, the elongate contact arms 2' each differ from contact arms 2 in that each is formed of alternating sheets of high conductivity copper 20' and copper spring metal 22' which has about half of the conductivity of the high conductivity copper. Also, the entire contact arm 2' protrudes from the lower end of the housing for connection to mating conductor paths. At the free end of the cantilevered arm 2' about half of the sheets 20' and 22' on the side remote from the slot 10 extend beyond the remaining sheets to provide a recessed surface 32 which actually engages the preload abutment 14. However, as indicated above in relation to the first embodiment, all the sheets could be made coterminous and the thickness of the abutment 14 reduced in proportion to achieve the same degree of preloading and positioning of the contact surface 26.

FIG. 3 also illustrates that, instead of using clamps, the cantilevering of the contact arms 2, can be achieved by receiving ends 3 in slots in the housing or embedding ends 3 in the housing. Also, in FIG. 3 the contact arms are shown extending vertically. Preloading could theoretically be achieved by using copper spring metal sheets 22' which are slightly curved so that they have an elastic memory trying to pull the contacts 23 inwardly but the more practical arrangement is as shown in FIG. 1 wherein spring preloading is achieved by bending the contact arms out of the vertical.

Figure 5:
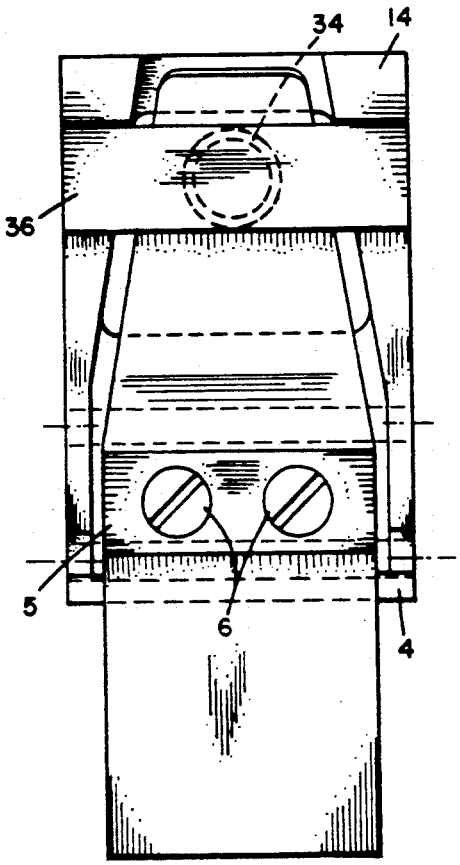
FIG. 5 is a side view of the connector of FIG. 4.
Figure 4:
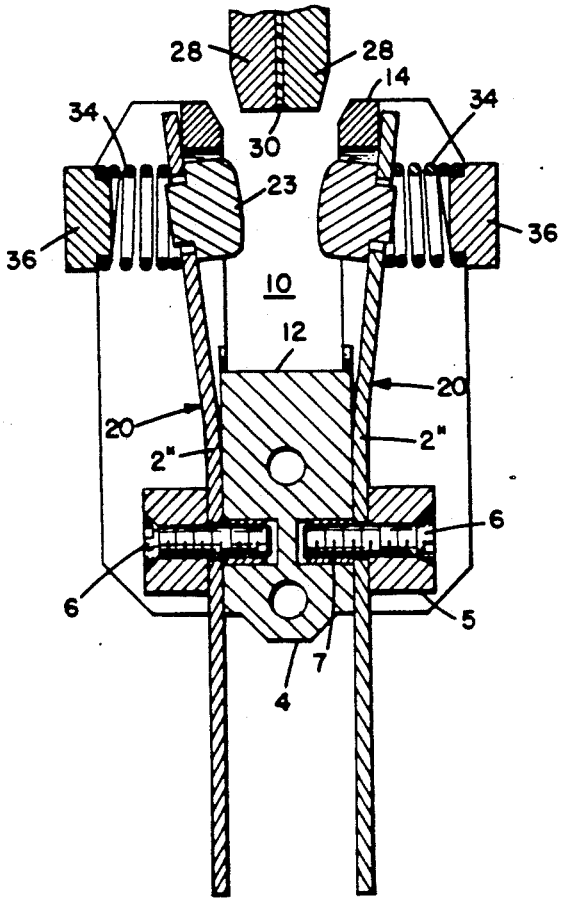
FIG. 4 is a cross-sectional view through a connector according to a third embodiment of the invention.

Turning now to FIGS. 4 and 5, these show a third embodiment of the invention which is identical to the first embodiment with the principal exception that the spring beam 20 of each contact arm 2" is replaced with a spring steel coil spring 34 which is located in alignment with the contact 23. The coil spring 34 is secured between a transverse housing portion 36 and the contact arm 2" to urge the contact 23 towards the slot 10. The contact 23 could be provided with a shank, as illustrated in the first embodiment, for locating an end of the respective coil spring 34, but in the embodiment shown in FIGS. 4 and 5 the shank has been omitted.

In the three embodiments of the invention described, by controlling the physical and chemical characteristics of the metals, both the mechanical and electrical characteristics of the contact arms may be controlled, balanced and optimized.

From the above description it will be apparent that the heart of the connector design is the use in a single contact arm of two types of metal. One type of metal is highly conductive, but has less than ideal mechanical spring characteristics. The other type of metal has good mechanical spring characteristics, but has higher electrical resistivity. By combining the two types of metal in a stack according to the first and second embodiments or by using the highly conductive material as the contact arm per se and combining it with a spring made of the other material as used in the third embodiment, a hybrid results, which offers a better combination of mechanical and electrical characteristics than either individual material does. Also, contact mounting arrangements other than cantilevers could be employed.

Additionally, the use of a stack of thin layers rather than a single thick layer permits the contact arm to be more flexible.

In an actual connector built according to the design illustrated in FIGS. 1 and 2 each contact arm consisted of ten layers of 10 mil copper CDA 110 and one 25 mil thick spring steel layer and this achieved a 20 lb force which gave a voltage drop of 16 mV at 300 Amps. It should be appreciated however, that many different combinations of numbers of layers and thicknesses would be feasible and the invention should not be limited to these particular parameters. Moreover, instead of the single steel layer illustrated in FIG. 1, the steel beam could be made of two or more layers. Additionally, such steel layers could all be of the same dimensions or they could be staggered in length from the outside to the inside in the manner of a leaf spring.

If desired, a single contact could be used in the housing, requiring two connectors to be employed when receiving a pair of conductors or bus bars 28. The output of each connector would extend out to a different conductor path.

With regard to the embodiment illustrated in FIG. 3, the high conductivity layers 20' are seen to alternate with the copper spring layers 22'. In a modification of that embodiment several layers 20' could be provided adjacent other and similarly several layers 22' could be provided adjacent each other so that, strictly, the layers 20' do not alternate with the layers 22' but, rather, the two sets of layers are interspersed.

It will therefore be apparent to those skilled in the art that various modifications and variations can be made in the apparatus of the present invention. Thus, it is intended that the specification and drawings be considered as exemplary only, with the true scope and spirit of the invention being indicated by the following claims, and their equivalents.

What is claimed is:

1. An electrical connector for releasable connection to a mateable contact, the connector comprising:

a housing formed with a slot, the slot extending inwardly from an end of the housing for receiving the mateable contact;

at least one elongate contact arm entirely secured within the housing and formed as a cantilever having a free end, wherein the elongate contact arm is formed of at least two beams, one of the which has relative high electrical conductivity but relatively poor mechanical spring characteristics and the other of which has relatively low electrical conductivity but relatively good mechanical spring characteristics; and a contact surface of relatively high electrical conductivity separably coupled to the contact arm proximate the free end and projecting laterally with respect to the slot through the housing into the slot such that the contact surface will engage the mateable contact upon insertion of the mateable contact into the slot.

2. An electrical connector for releasable connection to a mateable contact, the connector comprising:

a housing formed with a slot, the slot extending inwardly from an end of the housing for receiving the mateable contact;

at least one elongate contact arm secured within the housing, formed as a cantilever having a free end and extending substantially parallel to the slot, wherein the elongate contact arm is formed of at least two beams, one of which has relatively high electrical conductivity but relatively poor mechanical spring characteristics and the other of which has relatively low electrical conductivity but relatively good mechanical spring characteristics;

a contact surface electrically coupled to the contact arm proximate the free end and projecting laterally through the housing into the slot such that the contact surface will engage the mateable contact upon insertion of the mateable contact into the slot, the contact surface being separably coupled to the elongate contact arm such that the one beam is permitted to slide relative to the other beam.

3. An electrical connector according to claim 2 in which the housing is formed with a preload abutment arranged to engage the free end of the elongate contact arm and hold it in a preloaded state in which a contact force is exerted at the contact surface in a direction laterally into the slot.

4. An electrical connector according to claim 2 in which one of the beams is formed of a stack of relatively high electrical conductivity sheets of poor mechanical spring characteristics and another of the beams is formed as a separate single beam of relatively low electrical conductivity and good mechanical spring characteristics, the single beam being provided as a backing to the stack of sheets.

5. An electrical connector according to claim 4 in which said stack is a stack of high conductivity copper sheets and said separate single beam is a beam of spring steel backing the stack of copper sheets.

6. An electrical connector according to claim 2 in which one of the beams is formed of first sheets of relatively high electrical conductivity, poor mechanical spring characteristics material and another of the beams is formed of second sheets of relatively low electrical conductivity, good mechanical spring characteristics material, said first and second sheets being interspersed.

7. An electrical connector according to claim 6 in which said first sheets are sheets of high conductivity copper and said second sheets are sheets of copper spring metal having a conductivity approximately half that of the high conductivity copper.

8. An electrical connector according to claim 2 in which one of the beams is formed of first sheets of relatively high electrical conductivity, poor mechanical spring characteristics material and another of the beams is formed of second sheets of relatively low electrical conductivity, good mechanical spring characteristics material, said first and second sheets alternating with each other.

9. An electrical connector according to claim 8 in which said first sheets are sheets of high conductivity copper and said second sheets are sheets of copper spring metal having a conductivity approximately half that of the high conductivity copper.

10. An electrical connector for releasable connection to two mateable contacts, the connector comprising:

a housing of insulating material formed with a slot for reception of the two mateable contacts, the slot extending inwardly from an end of the housing;

two elongate contact arms secured within the housing and extending substantially parallel to the slot and on opposite sides of the slot and each elongate contact arm having a free end, each elongate contact arm being formed of at least two beams, one of the beams of each elongate contact arm formed of a stack of relatively high electrical conductivity sheets of poor mechanical spring characteristics and another of the beam of each elongate contact arm formed as a separate single beam of relatively low electrical conductivity and good mechanical spring characteristics, the single beam of each elongate contact arm being provided as a backing to its respective stack of sheets, and being mounted for sliding movement relative thereto;

a respective contact surface electrically coupled to each elongate contact arm proximate the free end, the contact surface projecting laterally into the slot for respective engagement with one of the mateable contacts; and a preload abutment formed in said housing to engage the free end of each elongate context arm and hold it in a preloaded state in which a contact force is exerted at the respective contract surface in a direction laterally in the slot.

11. An electrical connector for releasable connection to two mateable contacts, the connector comprising:

a housing of insulating material formed with a slot for reception of the two mateable contacts, the slot extending inwardly from an end of the housing;

two elongate contact arms secured within the housing and formed as cantilevers extending substantially parallel to the slot and on opposite sides of the slot, each cantilever having a free end and being formed of at least two beams one of which has relatively high electrical conductivity but relatively poor mechanical spring characteristics and the other of which has relatively low electrical conductivity but relatively good mechanical spring characteristics;

a respective electrically conductive contact surface, separably coupled to each one of the two elongate contact arms proximate the free end such ah the on beam is permitted to slide relative to the other beam, the contact surface projecting laterally into the slot for respective engagement with one of the mateable contacts.

* * * * *